US008795023B2

(12) United States Patent
Elson

(10) Patent No.: US 8,795,023 B2
(45) Date of Patent: Aug. 5, 2014

(54) CONVERTIBLE PLAY GYM

(75) Inventor: Brittany Elson, Atlanta, GA (US)

(73) Assignee: Kids II, Inc., Atlanta, GA (US)

( * ) Notice: Subject to any disclaimer, the term of this patent is extended or adjusted under 35 U.S.C. 154(b) by 0 days.

(21) Appl. No.: 13/614,945

(22) Filed: Sep. 13, 2012

(65) Prior Publication Data

US 2013/0244533 A1 Sep. 19, 2013

Related U.S. Application Data

(60) Provisional application No. 61/534,115, filed on Sep. 13, 2011, provisional application No. 61/596,378, filed on Feb. 8, 2012.

(51) Int. Cl.
*A63H 33/00* (2006.01)

(52) U.S. Cl.
CPC ..... *A63H 33/006* (2013.01)
USPC ..... 446/227

(58) Field of Classification Search
CPC .... A63H 33/006; A63H 33/00; A63H 33/003
USPC ..... 446/71, 75, 77, 227, 397, 482
See application file for complete search history.

(56) References Cited

U.S. PATENT DOCUMENTS 4,627,588 A * 12/1986 Block ..... 248/163.2
D339,173 S 9/1993 Marschak
5,260,869 A 11/1993 Ferrier et al.
5,454,745 A * 10/1995 Spielberger ..... 446/71
5,478,268 A 12/1995 Au
5,788,253 A * 8/1998 Thomson et al. ..... 280/87.041
6,000,750 A * 12/1999 Rossman et al. ..... 297/2
6,053,878 A 4/2000 Fell et al.
6,113,455 A 9/2000 Whelan et al.
6,203,395 B1 3/2001 McElhaney
D451,970 S 12/2001 Chan
6,332,824 B2 12/2001 Tell et al.
6,540,579 B1 * 4/2003 Gubitosi et al. ..... 446/227
6,702,643 B1 * 3/2004 Drosendahl et al. ..... 446/227
6,742,749 B2 6/2004 Kassai et al.
7,244,165 B2 * 7/2007 Gubitosi et al. ..... 446/175

(Continued)

OTHER PUBLICATIONS

KIDS II, Inc., "Baby Neptune Ocean Adventure Gym," Product No. 30939 Instruction Manual, 2008, 8 pages, China.

(Continued)

*Primary Examiner* — Kurt Fernstrom
(74) *Attorney, Agent, or Firm* — Alston & Bird LLP

(57) ABSTRACT

Various embodiments of the present invention are directed to a children's play gym configured for being converted between different configurations providing unique functionalities. In certain embodiments, the convertible play gym is provided with one or more adaptable entertainer components including various entertainment features (e.g., lights and sound producing devices). In a first configuration adapted for infants, at least one of the entertainer components is suspended above the play gym's mat and configured for reacting to movement, sound, or other input provided by an infant child laying on the play gym's mat. In a second configuration adapted for toddlers, the suspended entertainer component may be detached from the play gym's support members and reconfigured as a children's entertainment table (e.g., by itself or as part of an assembly with other entertain components).

22 Claims, 11 Drawing Sheets

(56) References Cited

U.S. PATENT DOCUMENTS

| | | | | |
|---|---|---|---|---|
| 7,287,768 | B2 * | 10/2007 | Myers et al. | 280/87.051 |
| 7,523,984 | B2 * | 4/2009 | Steininger | 297/16.1 |
| 7,963,896 | B2 | 6/2011 | Nanna et al. | |
| 8,267,803 | B2 * | 9/2012 | Trapp et al. | 472/135 |
| 2002/0164917 | A1 * | 11/2002 | Keegan et al. | 446/71 |
| 2004/0242118 | A1 | 12/2004 | Schreiber Setzemski et al. | |
| 2010/0015882 | A1 | 1/2010 | Givens | |

OTHER PUBLICATIONS

Mattel, "Fisher-Price Discover 'n Grow Kick and Play Piano Gym," Product No. W2621 Instruction Manual, 2012, 6 pages, China.

Mattle, "Fisher-Price My Little Sungabunny Ultra Comfort Musical Gym," Product No. X2916 Instruction Manual, 2012, 6 pages, China.

Mattel, "Fisher-Price Ocean Wonders Kick and Crawl Gym," Product No. P5331 Instruction Manual, 2012, 6 pages, China.

* cited by examiner

CONVERTIBLE PLAY GYM

CROSS-REFERENCE TO RELATED APPLICATIONS

This application claims priority from provisional U.S. Application No. 61/534,115 entitled "Convertible Play Gym," which was filed on Sep. 13, 2011, and from provisional U.S. Application No. 61/596,378 entitled "Convertible Play Gym," which was filed on Feb. 8, 2012, each of which is herein incorporated by reference in its entirety.

BACKGROUND OF THE INVENTION

1. Field of the Invention

Various embodiments of the present invention described herein generally relate to children's play gyms.

2. Description of Related Art

Conventional children's play gyms include a mat and one or more support bars extending over the mat to suspend various toys, such as rattles, mirrors, and plush characters. Such play gyms are typically adapted for infant children and are configured such that the infant can lie on the mat and play with the toys suspended above the mat by the support bars. However, such conventional play gyms provide limited interactive functionality and are generally ill-equipped for developing a child's gross motor skills and/or verbal skills. In addition, conventional play gyms are not adaptable for use as infant children grow older and either outgrow or outdevelop the play gym.

Accordingly, there exists a need in the art for an improved play gym that is interactive and responsive to an infant's motion and/or noise and that is configured for encouraging an infant to develop their gross motor skills and/or verbal skills. In addition, there exists a need in the art for a versatile play gym that can be converted for use by children of various ages from infancy through toddlerhood.

BRIEF SUMMARY OF THE INVENTION

Various embodiments of the present invention are directed to a children's play gym configured for being converted between a first configuration and a second configuration. According to various embodiments, the play gym comprises: a mat configured for resting on a support surface; one or more support members configured for being operatively connected to the mat; and one or more entertainer components having one or more entertainment features for entertaining a child. According to various embodiments, in the first configuration, the one or more support members extend upwardly and over the mat and at least a first entertainer component of the one or more entertainer components is coupled to one or more of the support members such that the first entertainer component is suspended above the mat. In addition, in the second configuration, the first entertainer component is decoupled from the support members and the one or more entertainer components are configured in a table configuration to function as a children's entertainment table.

Various other embodiments of the present invention are directed to a children's entertainment device for a play gym. According to various embodiments, the children's entertainment device comprises one or more entertainer components having one or more entertainment features for entertaining a child, the one or more entertainer components being convertible between an attachment configuration and a table configuration. According to various embodiments, in the attachment configuration, at least a first entertainer component of the one or more entertainer components is configured for being removably coupled to one or more support members of a children's play gym. In addition, in the table configuration, the one or more entertainer components are configured to function as a children's entertainment table.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION OF THE INVENTION

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Various embodiments of the present invention are directed to a children's play gym configured for being converted between different configurations providing unique functionalities. In various embodiments, the various configurations may be adapted for use by children of varying ages. For example, in certain embodiments, the convertible play gym is provided with one or more adaptable entertainer components, which may include various motion or noise sensors configured to activate various entertainment features (e.g., lights and sound producing devices). In a first configuration adapted for infants, at least one of the entertainer components is suspended above the play gym's mat and configured for reacting to movement, sound, or other input provided by an infant child laying on the play gym's mat. In a second configuration adapted for toddlers, the suspended entertainer component may be detached from the play gym's support members and reconfigured as a children's entertainment table (e.g., by itself or as part of an assembly with other entertainer components). In this second configuration, the children's entertainment table can be used by older infants or toddlers that have developed sufficient strength to sit upright and play with the features on the table. Exemplary embodiments of such convertible children's play gyms are described in greater detail below.

Convertible Children's Play Gym

Figure 1:
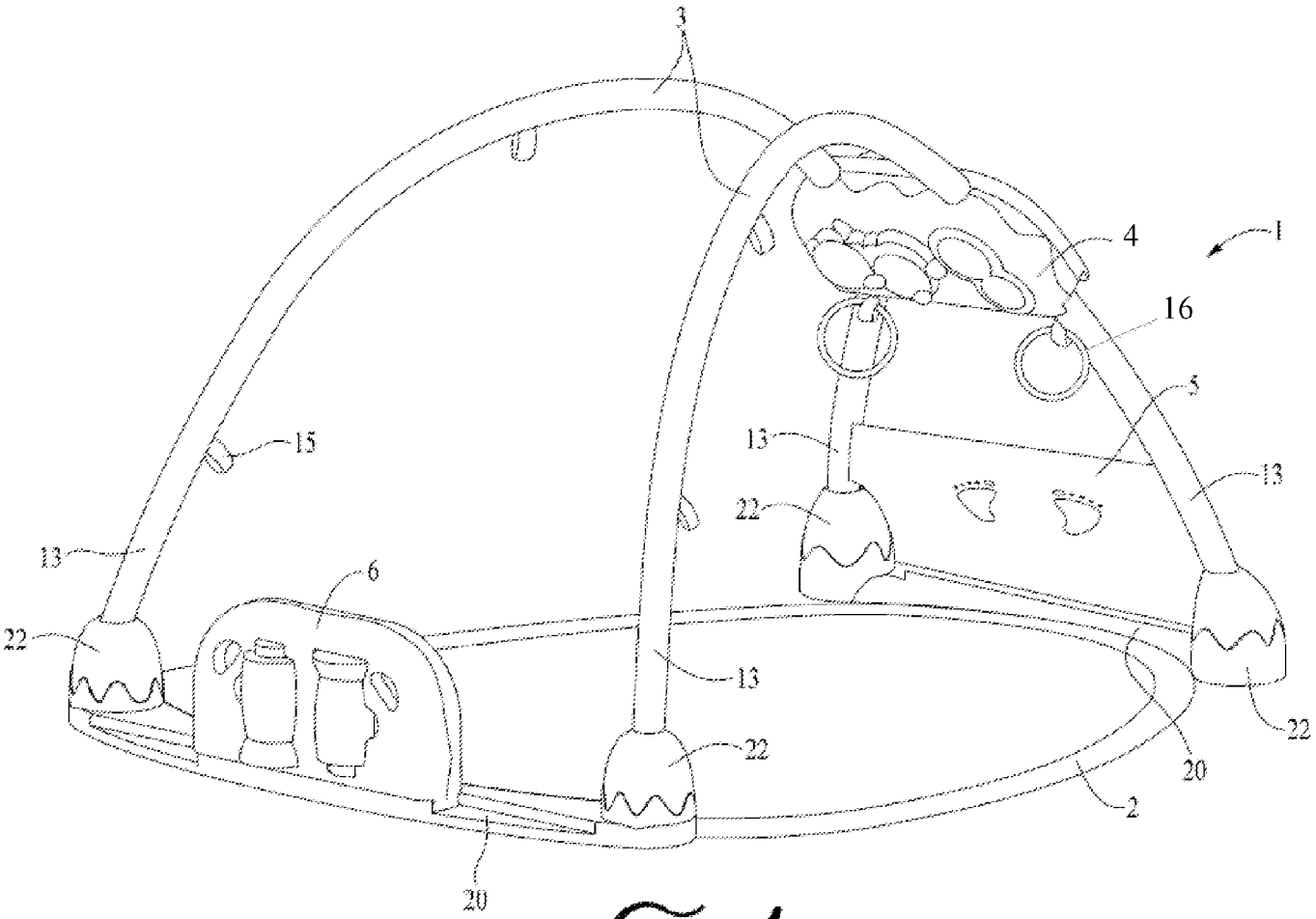
FIG. 1 shows a perspective view of a convertible play gym in a first configuration according to one embodiment of the present invention.

FIG. 1 illustrates a convertible play gym 1 according to one embodiment of the present invention. In the illustrated embodiment, the play gym 1 generally comprises a mat 2, a pair of base members 20, a pair of support members 3, a kick pad 5, a first entertainer component 4, and a second entertainer component 6. In particular, FIG. 1 illustrates the play gym 1 in a first configuration adapted for infants. In the first configuration, the mat 2 is configured to rest on a support surface (e.g., a floor) and is configured to provide a comfortable surface to support an infant in a seated or laying position. The base members 20 are positioned at opposite ends of the mat 2 and each base member 20 defines a pair of upwardly extending receiving portions 22 at its lateral sides. The receiving portions 22 of the base members 20 include apertures configured to receive the support members 3.

In the first configuration of FIG. 1, distal end portions 13 of the support members 3 are inserted into the receiving portions 22 in order to couple the support members 3 to the base members 20. In the illustrated embodiment, the end portions 13 include fabric loops 14 (shown in FIG. 3) that may be threaded through the receiving portions 22 of the base members and secured to hooks positioned on the underside of the mat 2, thereby coupling the support members 3 and base members 20 to the mat 2. In various other embodiments, however, the support members 3 may be coupled to the base members 20 using any suitable fasteners and the base members 20 may be coupled to the mat 2 using any suitable fasteners. In further embodiments, the support members may be directly coupled to the mat 2 and the base members 20 may be omitted.

As shown in FIG. 1, the support members 3 extend upwardly from the base members 20 and over the mat 2, each support member 3 forming a generally arcuate shape. In the illustrated embodiment, the support members 3 are generally flexible and formed from a resilient material, such as fiberglass and/or polyurethane foam. However, the support members 3 may alternatively be formed from a more rigid material that is pre-formed in an arc shape. In addition, the support members 3 may be wrapped in a cushioning material, such as foam. In the illustrated embodiment, the support members 3 also include one or more toy loops 15 from which hanging toy elements (e.g., rings 16, pacifiers, or other hanging toy elements) may be removably secured. In other embodiments, the hanging toy elements may be permanently coupled to the toy support members 3.

In the first configuration, the first entertainer component 4 is coupled to the support members 3 such that it is suspended above the mat 2. As described in greater detail herein, the first entertainer component 4 includes a plurality of entertainment features 80 (shown in FIGS. 2 and 9) configured to illuminate, emit sounds, and/or otherwise respond to input from an infant positioned on the mat 2. To sense such input, the first entertainer component 4 can also include various sensing devices, such as motion sensors and noise sensors. As shown in FIG. 1, in the first configuration, the first entertainer component 4 is positioned such that the entertainment features 80 are facing the mat 2. As such, in the first configuration, an infant lying on the mat 2 can easily interact with and/or view the entertainment features 80.

According to various embodiments, the entertainment features 80 may comprise one or more lights (e.g., LEDs), noise making devices (e.g., speakers, buzzers), and/or motion devices (e.g., rotating components, such as a hanging toy, powered by an electric motor). In addition, according to various embodiments, the sensing devices may comprise one or more motion sensors (e.g., a jiggle switch) and/or noise sensors (e.g., a microphone). In various embodiments, certain of the entertainment features 80 may be configured to react to input from a child sensed by the sensing devices (e.g., where the sensing devices are configured to activate one or more of the entertainment features 80). For example, in one embodiment, the first entertainer component 4 may be configured to activate one or more of the entertainment features 80 in response to audible sounds produced by an infant (e.g., laughing, crying, babbling, talking).

In addition, in the illustrated embodiment of FIG. 1, the play gym's kick pad 5 is coupled at its lateral sides to the end portions 13 of the support members 3 and on its lower side to one of the base members 20. As such, the kick pad 5 is positioned such that an infant lying on the mat 2 can easily kick the kick pad 5, thereby generating motion imparted from the kick pad 5 to the support members 3 that may be sensed by the first entertainer component 4. For example, in such embodiments, the first entertainer component 4 may include a motion sensor configured to detect movement or vibration and thereby trigger one or more of the entertainment features 80. According to various embodiments, the kick pad may be formed from a soft, resilient material, such as poly-pongee webbing. Other potential materials suitable for forming the kick pad 5 include, but are not limited to, various plastics, fabrics, fibers, and rubbers.

In the first configuration shown in FIG. 1, the play gym's second entertainer component 6 is removably connected to one of the base members 20 opposite the kick pad 5. According to various embodiments, the second entertainer component 6 may include various entertainment features, which may be features that are the same as or similar to those described above in relation to the first entertainer component 4, as well as features manually activated by an infant (e.g., buttons, mirrors, or components configured to be moved by an infant's hand). In addition, certain of these entertainment features may be activated in response to user input from a child sensed by one or more sensing devices provided in the second entertainer component 6 (e.g., sensing devices that are the same as or similar to those described above in relation to the first entertainer component 4). In the illustrated embodiment of FIG. 1, the second entertainer component 6 is secured to its respective base member 20 such that it extends upwardly from the base member 20 in a generally upright orientation. In particular, the second entertainer component 6 is oriented such that its entertainment features face the mat 2. As such, in the first configuration of FIG. 1, an infant can activate the entertainment features of the second entertainer component 6 while lying on the mat 2 on his or her stomach. An infant's play while in this position is commonly referred to as "tummy-time", which includes the benefits of strengthening the infant's neck muscles and encouraging him to crawl.

According to various other embodiments, the entertainer components 4, 6 may not include a sensing device and may be configured to activate without input from a child. For example, in such embodiments, the entertainment features of the entertainer components 4, 6 may be programmed to activate in response to an on/off switch (e.g., activated by a user), or may be programmed to activated according to a preprogrammed sequence (e.g., various lights and sounds playing over a predefined period of time). In other embodiments, the entertainer components 4, 6 may not include any electronic device (e.g., where the entertainer components include only hanging toys or mirror features).

As described in greater detail below, the convertible play gym 1 can be easily assembled into the first configuration shown in FIG. 1. In addition, the play gym 1 can be reconfigured into the second configuration in which the first and second entertainer components 4, 6 are decoupled from the support members 3 and base members 2 and secured together in a table configuration.

Assembly of Convertible Play Gym in First Configuration

Figure 2:
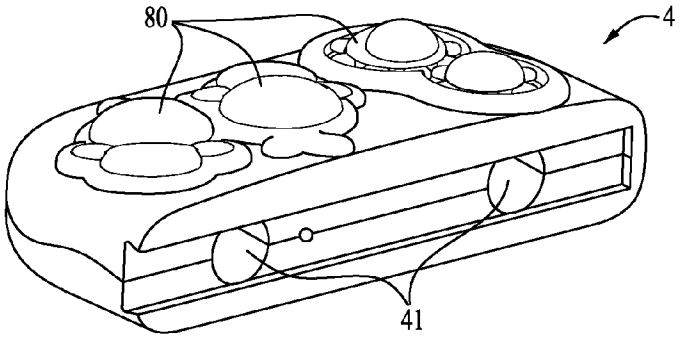
FIG. 2 shows a perspective view of a first entertainer component according to one embodiment of the present invention.

FIGS. 2 through 5 provide illustrations indicating an assembly method for configuring the convertible play gym 1 in the first configuration. FIG. 2 illustrates the first entertainer component 4 according to one embodiment. As shown in FIG. 2, the first entertainer component 4 includes a pair of apertures 41 configured for receiving the support members 3. In particular, the apertures 41 are dimensioned such that the support members 3 fit snugly within the apertures 41 and, when the support members 3 are inserted through the apertures 41, the first entertainer component 4 is secured in a fixed position on the support members 3 absent deliberate force by a user to slide the first entertainer component along the support members 3.

Figure 3:
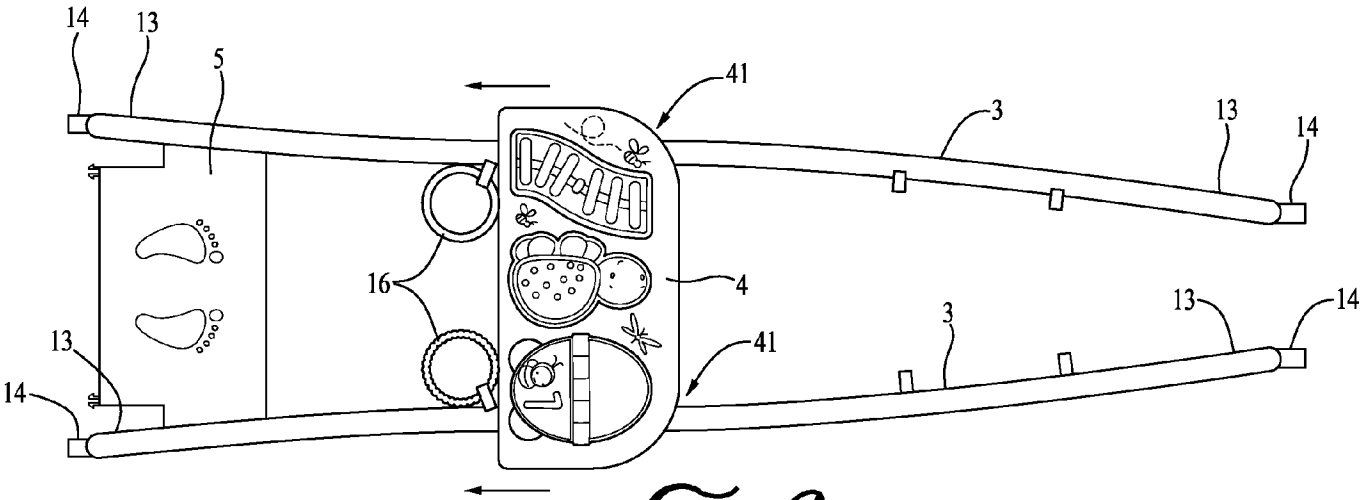
FIG. 3 shows a perspective view of a first entertainer component being coupled to support members of a convertible play gym according to one embodiment of the present invention.

For example, FIG. 3 shows a top view of the disassembled play gym 1 as the first entertainer component 4 is being coupled to the support members 3. As shown by the directional arrows in FIG. 3, a user may thread the end portions 13 of the support members 3 through the apertures 41 of the first entertainer component 4. Thereafter, the user can slide the first entertainer component 4 along the support members 3 to a desired position. In the illustrated embodiment, a pair of toy loops and rings 16 permanently attached to the support members 3 serve as a stop surface when sliding the first entertainer component 4 on to the support members 3 and indicate to a user the proper position of the first entertainer component 4. In the illustrated embodiment, the stopping surface is positioned such that the first entertainer component 4 is not slid too far down the support members 13, thereby ensuring the lower portions of the support members 13 are properly spaced. In other embodiments, the stopping position may be defined by a fabric strip sewn to both support members 13 and extending therebetween. In other embodiments, a locking mechanism may be provided on the support members 3 to releasably secure the first entertainer component 4 to the support members 3. In such embodiments, multiple locking mechanisms may be provided along the support members 3 to enable a user to position the first entertainer component 4 at various positions along the support members 3.

After coupling the first entertainer component 4 to the support members 3, a user may insert the distal end portions 13 of the support members 3 into the receiving portions 22 in order to couple the support members 3 to the base members 20. As noted above, the end portions 13 include fabric loops 14 that may be threaded through the receiving portions 22 of the base members and secured to hooks positioned on the underside of the mat 2, thereby coupling the support members 3 and base members 20 to the mat 2. In this way, the mat 2, support members 3, base members 20, and first entertainer component 4 can be secured in the configuration of FIG. 1.

Figure 4B:
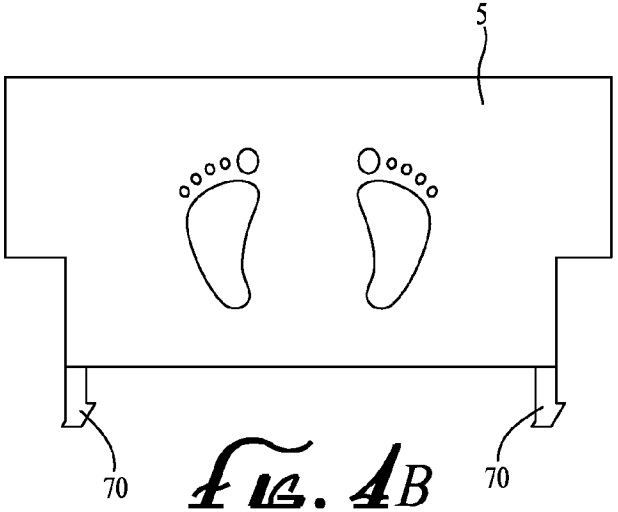
FIGS. 4A-4C shows a kick pad assembly of a convertible play gym according to one embodiment of the present invention.
Figure 4C:
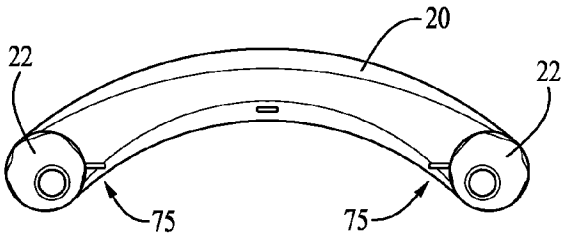
Figure 4A:
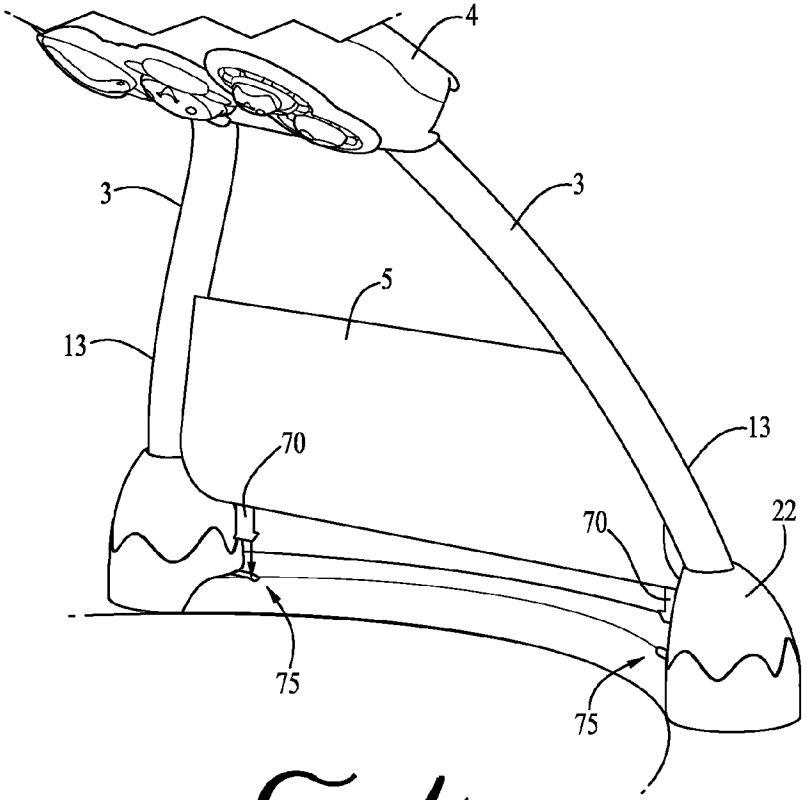

In addition, when securing the support members 3 to the base members 20, the kick pad 5 may also be secured in place. FIGS. 4A-4C illustrate the kick pad 5 and a method for securing it to the play gym 1 in the first configuration. In the illustrated embodiment of FIG. 4A, lateral sides of the kick pad 5 are attached to lower portions of the support members 3 (e.g., permanently secured by sewing or an adhesive). As shown in FIG. 4B, the kick pad 5 also includes a pair of flexible T-shaped straps 70 positioned on its lower edge proximate its lateral sides. The straps 70 are configured to be inserted into slits 75 formed in the base member 20, shown in FIG. 4C. As shown in FIG. 4A, when the end portions 13 of the support members 3 are coupled to the base member 20, the kick pad's straps 70 can be inserted into the slits 75 defined in the base member 20, thereby securing the kick pad 5 to the base member 20. In this configuration, the kick pad 5 is secured in tension between the support members 3 and provides stable, resilient surface against which an infant may kick. Additionally, as will be appreciated form FIG. 4B the base member 20 is curved outwardly (i.e., away from the mat 2) such that the kick pad 5 is positioned nearer to the mat 2 than the base member 20. This positioning prevents infants from bumping their feet on the rigid base member 20 as they kick the kick pad 5.

In alternative embodiments, the kick pad 5 may be configured to removably couple to the base member 20 through snaps, hooks, ties, hook and loop fasteners, or other conventional fasteners. In addition, the kick pad 5 may be configured to be removable from the play gym 1. In such embodiments, the kick pad 5 may include a stand (not shown) or similar support structure that allows the kick pad to be propped upright and used separately from the play gym 1, such as, for example, in an infant crib or play yard. In these embodiments, the kick pad 5 may also include integrated speakers or lighting elements configured to activate when the kick pad 5 is used separately from the play gym 1.

Figure 5:
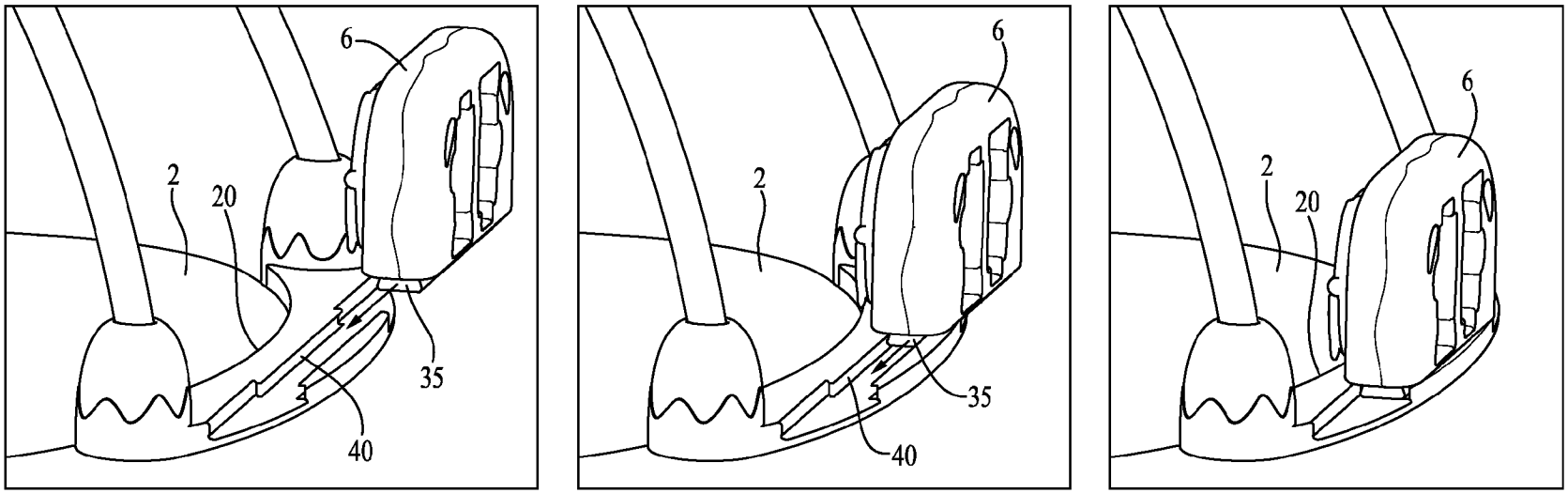
FIG. 5 shows steps performed in coupling a second entertainer component to the base member of a convertible play gym according to one embodiment of the present invention.

Next, the second entertainer component 6 is secured to the base member 20 opposite the kick pad 5. FIG. 5 illustrates an exemplary method of removably attaching the second entertainer component 6 to the base member 20. As shown in FIG. 5, the second entertainer component 6 includes a downwardly extending ridge 35 having a substantially trapezoidal cross-section (also shown in FIG. 7). The ridge 35 extends along the length of the second entertainer component's lower edge and is dimensioned to engage a channel 40 formed in the base member 20. As shown in FIG. 5, a user can slidably engage the second entertainer component's ridge 35 with the base member's channel 40 in order to secure the second entertainer component 6 to the base member 20 in a generally upright orientation with the second entertainer component's entertainment features facing the mat 2. As will be evident form FIG. 5, a user can selectively position the second entertainer component 6 at any distance along the channel 40 and can remove the second entertainer component 6 as desired.

According to various embodiments, the ridge 35 may be configured to have a triangular or circular cross-section. Alternatively, the second entertainer component 6 may be configured to snap, clip, tie, or otherwise removably attach to the base member 20. One advantage of the stable positioning of the second entertainer component 6 is that it will not slide away from the infant as he or she manually operates the various entertainment features provided on the second entertainer component 6.

Assembly of Convertible Play Gym in Second Configuration

As noted above, various embodiments of the children's play gym 1 can be converted by a user from the first configuration shown in FIG. 1, to a second configuration adapted use by older infants or toddlers that have developed sufficient strength to sit upright. Accordingly, in one embodiment, the play gym's first entertainer component 4 and second entertainer component 6 are configured for being detached from the support members 3 and base members 20 and secured together in a table configuration. The children's entertainment table formed by the mated entertainer components 4, 6 can then be used by older infants or toddlers on the mat 2 or elsewhere.

Figure 6:
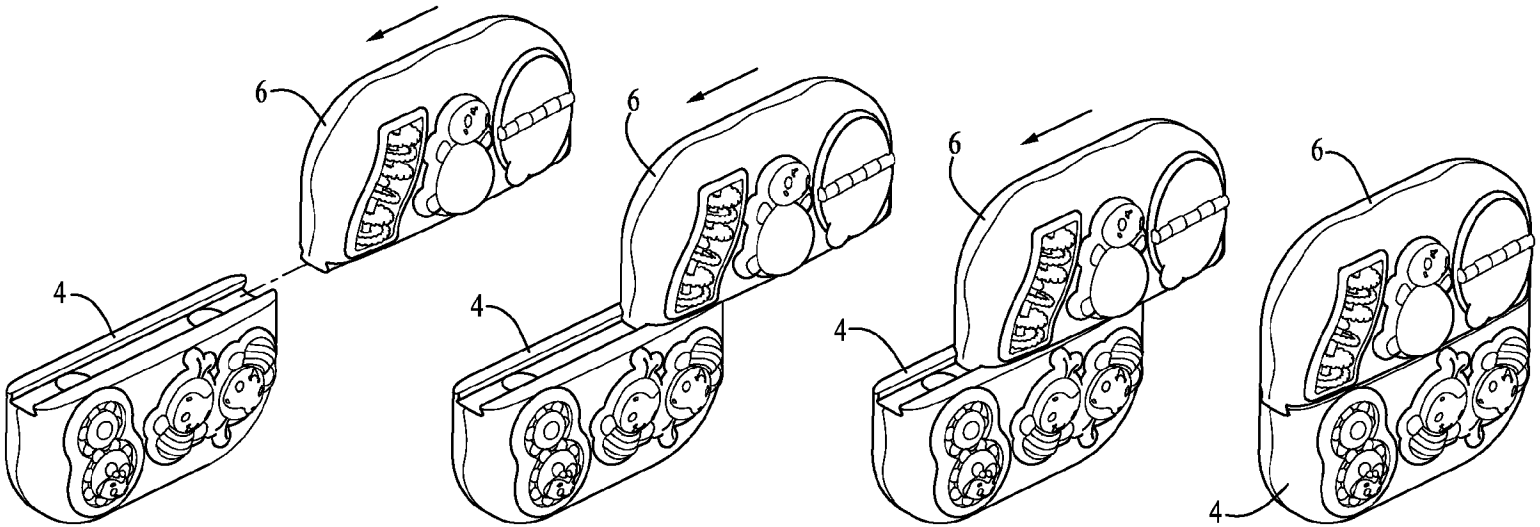
FIG. 6 shows steps performed in coupling a first entertainer component to a second entertainer component according to one embodiment of the present invention.

To convert the play gym 1 from the first configuration to the second configuration, the user may first detach the entertainer components 4, 6 from the play gym 1. Next, the entertainer components 4, 6 are slidably coupled together. For example, FIG. 6 shows the first entertainer component 4 slidably receiving the second entertainer component 6.

Figure 7:
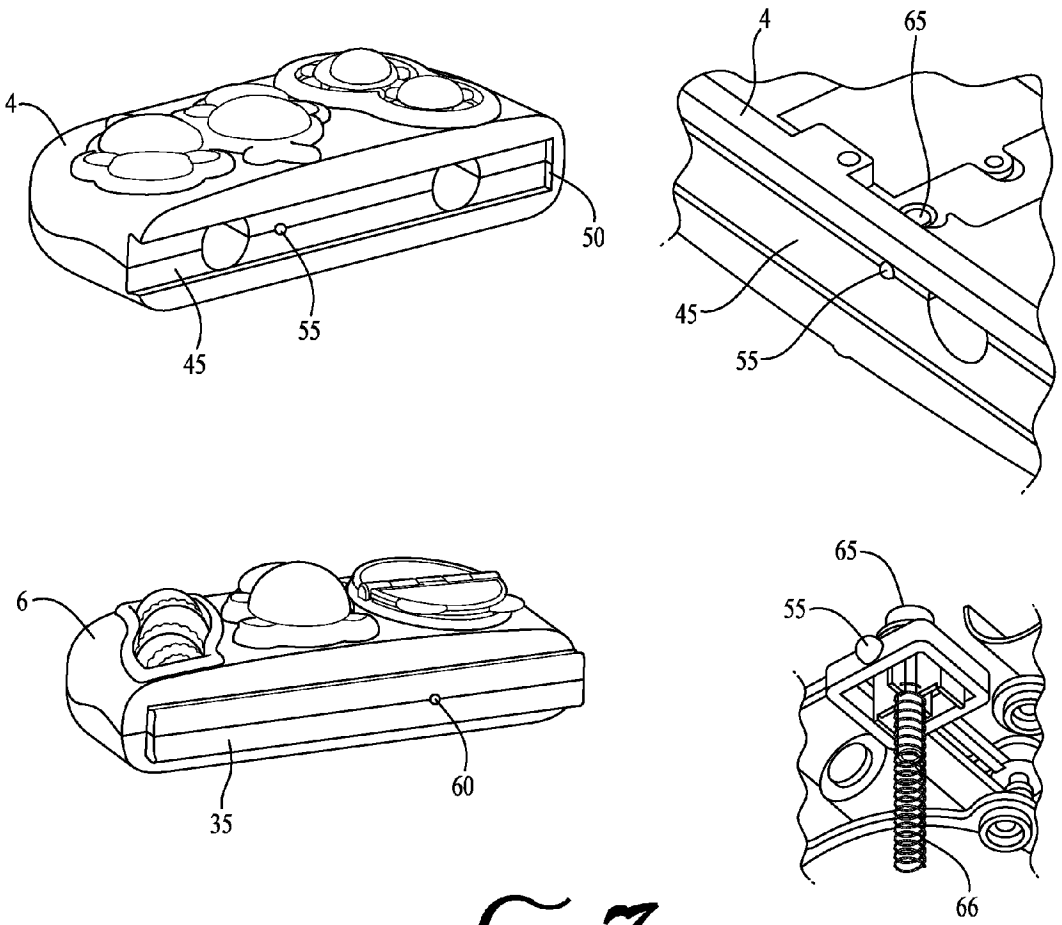
FIG. 7 shows perspective views of the attachment mechanisms of a first entertainer component and a second entertainer component according to one embodiment of the present invention.

FIG. 7 illustrates in greater detail the features used for attaching the first entertainer component 4 to the second entertainer component 6 when assembling the children's entertainment table. As noted above, the second entertainer component 6 includes a downwardly extending ridge 35 defined along its lower edge. The first entertainer component 4 includes a corresponding groove 45 dimensioned to slidably receive the ridge 35. The first entertainer component 4 also includes a stop surface 50 configured such that the second entertainer component 6 cannot slide past the desired position along the ridge 35. Accordingly, to secure the entertainer components 4, 6 together, a user may insert the second entertainer component's ridge 35 into the first entertainer component's groove 45 and slide the second entertainer component 6 along the groove 45 until it hits the stop surface 50.

As shown in FIG. 7, the first entertainer component 4 also includes a spring-loaded protrusion 55 configured to engage a corresponding recess (or divot) 60 defined on the second entertainer component 6 when the entertainer components 4, 6, are mated in the proper position. With the protrusion 55 engaged within the recess 60, the second entertainer component's ridge 35 cannot slide within the groove 45, thereby preventing the entertainer components 4, 6 from being disengaged when in the table configuration. To detach the entertainer components 4, 6, a user can press a release button 65 provided on the first entertainer component 4, which compress a spring 66 and thereby retracts the protrusion 55 from within the divot 60. The user can then slide the entertainer components 4, 6 apart. In various other embodiments, however, the entertainer components 4, 6 may be coupled together via any suitable fastening means (e.g., snaps, clips, magnets, etc.).

Figure 8:
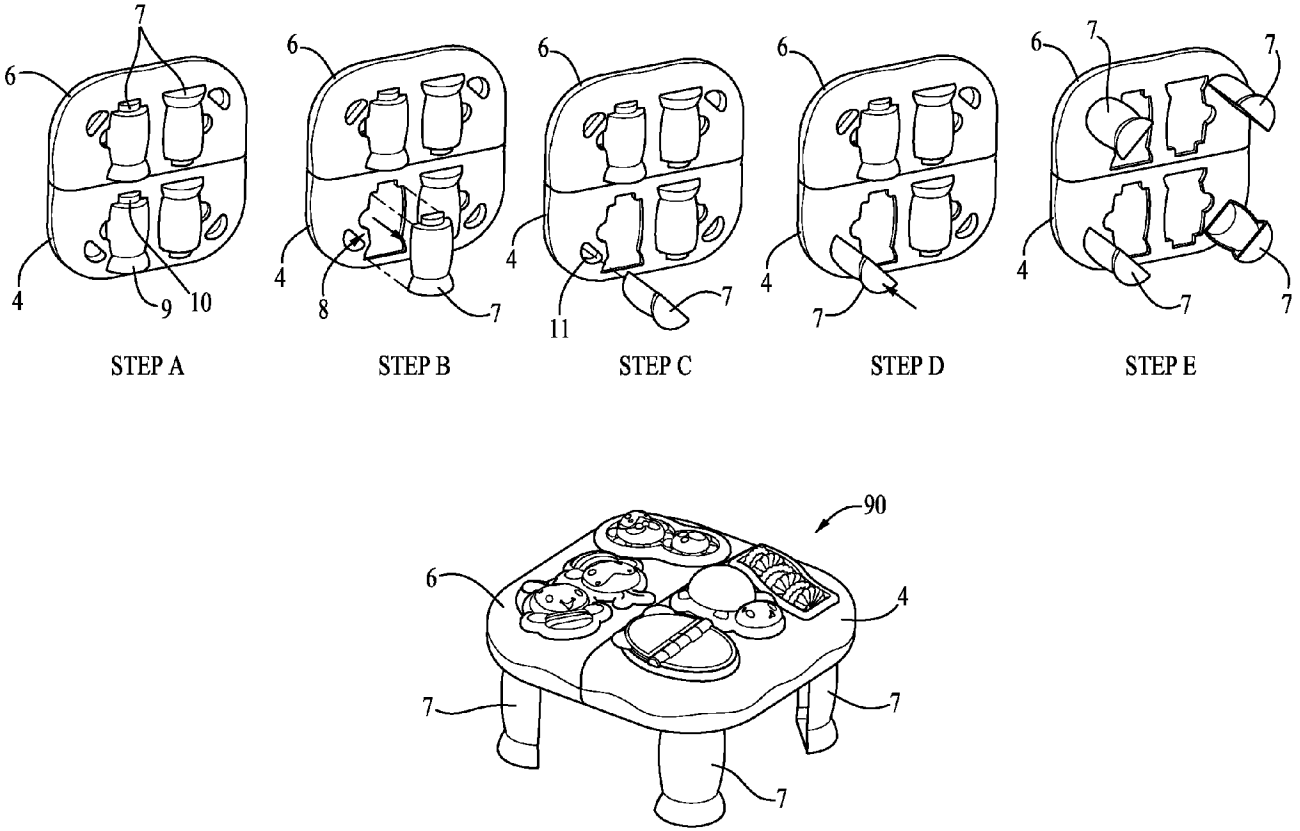
FIG. 8 shows steps performed to convert mated entertainer components into a children's entertainment table according to one embodiment of the present invention.

As shown in FIG. 8, both the first entertainer component 4 and the second entertainer component 6 include one or more support legs 7 configured to support the entertainer components 4, 6 in the table configuration. In particular, the various legs 7 of the entertainer components 4, 6 are movable between a retracted position and an extended position. For example, when secured to the play gym 1 in the first configuration, the legs 7 are in the retracted position (shown in Step A of FIG. 8). In the retracted position, each of the legs 7 is removably received within a recess 8 formed on a lower surface of the entertainer components 4, 6. Each support leg 7 includes a foot 9 configured to rest on a support surface (e.g., a floor, table top) and a projection 10 configured to couple to one of the entertainer components 4, 6 in the table configuration.

To convert the entertainer components 4, 6 to the table configuration, a support leg 7 is first popped out of its recess 8 (Step B of FIG. 8) and its projection 10 is then inserted into a slot 11 formed in the entertainer components 4, 6 (Steps C and D of FIG. 8). This process results in the leg 7 being moved to an extended position. The process is then repeated for each of the legs 7 to convert the entertainer components into the table configuration (Step E of FIG. 8). Once the entertainer components 4, 6 are in the table configuration, they are able to function as a children's entertainment table 90 and the play gym is effectively converted to the second configuration.

If it is preferred that the entertainer components 4, 6 serve as a floor toy instead of a table, a user can remove the support legs 7 from the recesses 8 and place the conjoined entertainer components 4, 6 on the floor (e.g., on the mat 2). Additionally, the entertainer components may include straps or similar fastening devices configured to allow a user to attach the conjoined entertainer components to alternate devices, such as, for example, the back of a vehicle seat, a play yard, or the rails of a crib.

Figure 9:
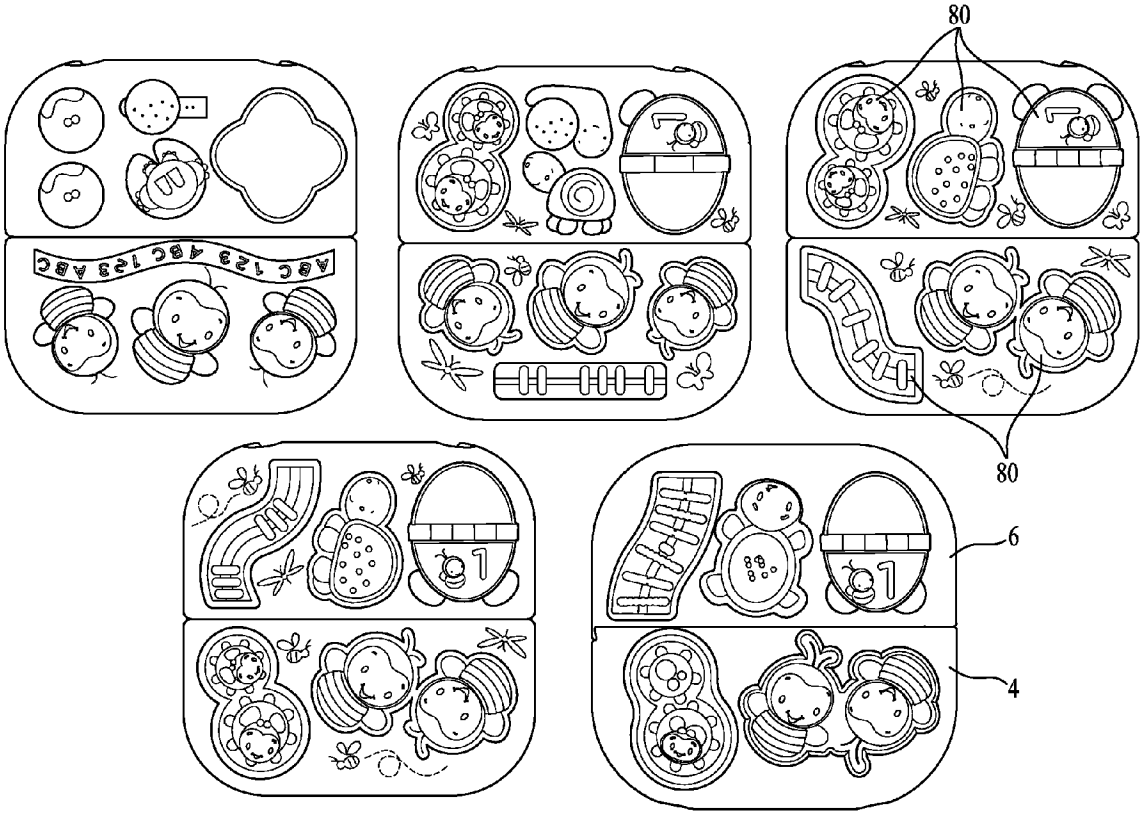
FIG. 9 shows a top view of entertainment features provided on a children's entertainment table according to various embodiments of the present invention.

FIG. 9 illustrates variations of the entertainment features 80 located on the first entertainer component 4 and second entertainer component 6 in the table configuration. As noted above, the first entertainer component 4 may include a lighting element, audio device, or motion device configured to activate in response to a sensed input from a child (e.g., an infant kicking the kick pad 5 in the first configuration). In addition, the second entertainer component 6 may include a manually-operable toy, such as, for example, a spinning rattle or a button that activates flashing lights, which an infant can actuate during "tummy-time" in the first configuration. Moreover, according to some example embodiments, the first entertainer component 4 and second entertainer component 6 may be reversible. For example, the surfaces opposing the entertainment features 80 may include a snack tray, art table, and/or additional entertainment features.

As will be appreciated from the description herein, the play gym 1 is configured for use with multiple ages of children. In the first configuration, young infants can lie on their back and receive an engaging interactive response when they kick or hit the kick pad 5 or support members 3, thus encouraging the infant to practice their large motor skills. Additionally, in the first configuration, older infants can lie on their stomach and manually operate the toy devices on the second entertainer component 6, which aids in both developing neck muscle strength and fine motor skills. Finally, in the second configuration, toddlers can sit up and play with the children's entertainment table, which strengthens their core and provides practice using fine motor skills. In addition, the adaptability of the entertainer components 4, 6 permits them to be used in a variety of contexts, both in and out of the play gym 1. For example, the entertainer components 4, 6 can be adapted for use with the play gym 1, secured to a crib, or used in various other environments.

Various Other Embodiments

As will be appreciated from the description herein, various changes and modifications to the convertible play gym 1 are contemplated as being within the scope of the present invention. For example, various components of the play gym 1 may be user-adjustable, such as, for example, the user may be able to selectively position the first entertainer component 4 at multiple positions along the support members 3. Furthermore, the play gym 1 may include an adjustment mechanism for selectively altering the length of the support members 3 (e.g., telescoping support members). In such embodiments, a user may be able to shorten the length of the support members 3 in order to reduce the distance between the first entertainer component 4 and the mat 2.

Figure 10:
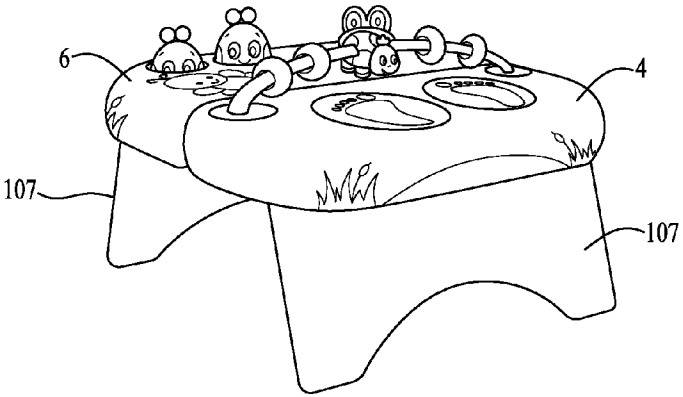
FIG. 10 shows a children's entertainment table according to another embodiment of the present invention.

In certain embodiments, the legs of the entertainer components 4, 6 may be provided with a different configuration. As an example, FIG. 10 shows one embodiment in which the entertainer components 4, 6 are provided with legs 107 that are hingedly coupled to the entertainer components 4, 6. In such an embodiment, the legs 107 may be configured to pivot between their retracted position (e.g., when in the first configuration) and an extended (e.g., when in the table configuration of the second configuration). In various other embodiments, the support legs 7 may be configured to move between a retracted and extended position by any suitable means.

Figure 11:
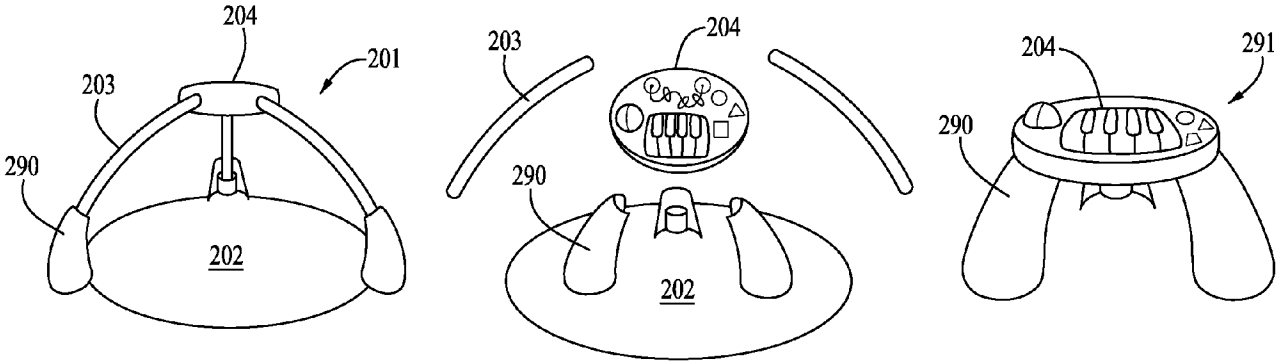
FIG. 11 shows a convertible children's play gym and children's entertainment table according to another embodiment of the present invention.

In addition, while the illustrated embodiments of FIGS. 1-9 include two entertainer components, other embodiments may include more or fewer entertainer components. For example, the play gym may include any number of entertainer components (e.g., the play gym may include one entertainer component configured to convert to a table, or may include multiple pieces which can be removably coupled together to form a table). As a particular example, FIG. 11 illustrates another example embodiment of a play gym 201 according to the present invention. The play gym 201 includes a mat 202, three base legs 290 coupled to the mat 2, three support members 203 removably coupled to and extending upward from the base legs 290, and a first entertainer component 204 removably coupled to the support members 203. To convert from a first configuration to a second configuration, a user may detach the first entertainer component 204 from the support members 203, detach the support members 203 from the base legs 290, and detach the base legs 290 from the mat 202. As shown in FIG. 11, the base legs 290 can then be coupled to the first entertainer component 204 to form a children's entertainment table 291.

Figure 12:
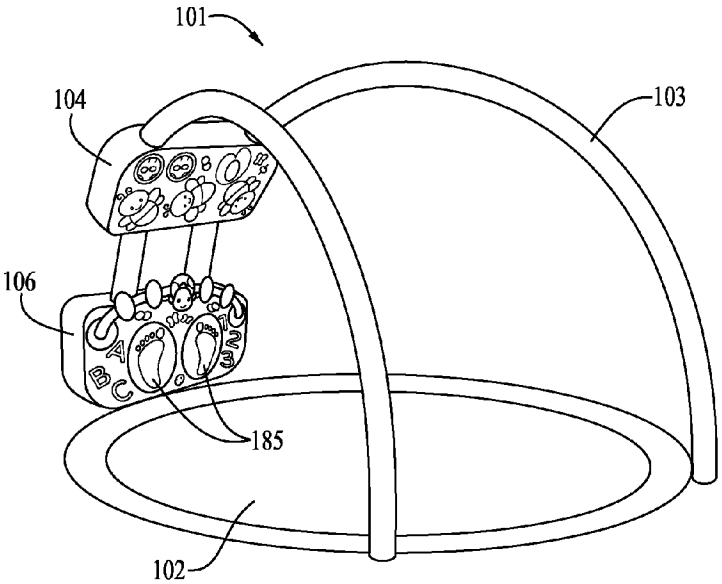
FIG. 12 shows a convertible children's play gym according to yet another embodiment of the present invention.

In other embodiments, the second entertainer component 6 may be attached elsewhere on the play gym 1, such as, for example, attached to the support members 3, to the mat 2, or to the first entertainer component 4. As an example, FIG. 12 illustrates an alternative example embodiment of a play gym 101 according to the present invention. The depicted embodiment includes a first entertainer component 104 and a second entertainer component 106, both of which are removably coupled to a pair of support members 103. The second entertainer component 106 is positioned adjacent the mat 102 and the first entertainer component 104 is positioned higher up on the toy support members 103 and above the mat 102 (e.g., via apertures in the manner shown and described in relation to FIGS. 2 and 3). The second entertainer component 106 includes a pair of large buttons 185 which are configured for an infant to kick or hit. In one embodiment, wiring between the first entertainer component 104 and the second entertainer component 106 causes lights, sounds, and/or motion to activate in the entertainer components when the buttons 185 are depressed. The buttons 185 may be cushioned or flexible, such that they are comfortable for an infant to kick or hit. Furthermore, as in the embodiment depicted in FIG. 3, the entertainer components 104, 106 are configured to be removed from the play gym 101 and converted for use as a children's entertainment table (or floor toy) (e.g., in the manner shown and described in relation to FIGS. 6-8).

Figure 13:
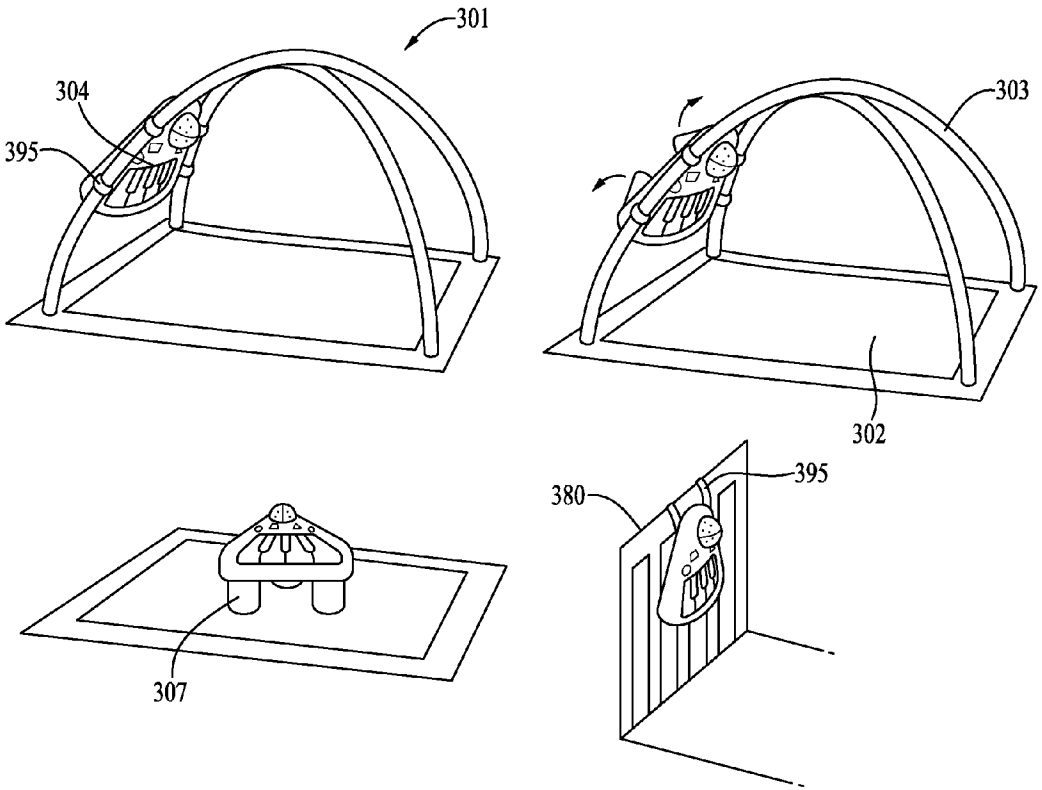
FIG. 13 shows a convertible children's play gym and children's entertainment table according to yet another embodiment of the present invention.

In addition, according to various embodiments, the first entertainer component 4 may be coupled to the support members 3 by alternate means, such as, for example, snaps, clips, ties, or otherwise fasteners. As an example, FIG. 13 depicts an additional exemplary embodiment of a play gym 301 according to the present invention. The play gym 301 includes a mat 302, a plurality of support members 303, and a first entertainer component 304 removably coupled to the support members 303. In this particular embodiment, the first entertainer component 304 is removably coupled to the support members 303 through a plurality of straps 395. When removed from the toy support members 303, the straps 395 allow the first entertainer component 304 to be coupled to a variety of alternative devices, such as, as depicted, a crib railing 380. Additionally, multiple support legs 307 are pivotably coupled to the first entertainer component 304, such that they are movable between a retracted position (e.g., when in the gym configuration) and an extended position (e.g., when in the table configuration of the second configuration).

Furthermore, a number of technologies may be employed to enable a child to activate the entertainer components via the kick pad 5. For example, in one embodiment, a jiggle switch is positioned in one of the support members 3 that is shaken when an infant kicks, hits, or otherwise strikes the kick pad 5. In such an embodiment, shaking the jiggle switch activates the lights, sounds, and/or other response in the first entertainer component 4 (which may be connected to the switch via a wired or wireless communication medium). The jiggle switch may also be triggered by an infant kicking, hitting, or otherwise striking the support members 3.

In addition, in some embodiments, the play gym 1 may be configured to sense the movement or noise from an infant by way of an alternative device, such as, for example, an infrared (IR) motion sensor, a microphone switch, carbon tracing in the mat 2, an air bladder (shoots air upward when kicked), and/or wiring from the kick pad 5 up to the first entertainer component 4. In other embodiments, the first entertainer component 4 may be operated by remote control, either by a user or by the infant. For example, the infant may wear a device, such as a sock or wrist wrap, that is configured to activate the first entertainer component 4 when the infant moves his foot or arm. Alternatively, the sock or wrist wrap may contain a noise-maker, such as bells or a rattle, which will trigger a microphone switch.

Additionally, the play gym 1 may include an animated screen located in the mat for entertainment during tummy time or above the mat for entertainment as the infant rests on his back. The play gym 1 may further include a projector configured to project lights and/or images onto the mat or a screen. Also, the play gym 1 may use RFID to allow communication between two separate entertainer components. The play gym 1 may also include an mp3 docking station and be configured to play music from a user's digital music player. The play gym 1 may also include content (i.e., songs, lessons, animations) for both infants and toddlers. For example, in the first configuration, the content may be tailored to infants and feature lullabies, lights, and silly sounds. In the second configuration (the table configuration), the content may be tailored towards toddlers and feature lessons in colors, counting, reading, etc. The play gym 1 may also include features that can be "unlocked" in the table configuration. For example, when the entertainer components are coupled together in the table configuration, new content may be accessed (such as, for example, audio that encourages the child to stand up at the children's entertainment table).

Conclusion

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A children's play gym configured for being converted between a first configuration and a second configuration, the play gym comprising:

a mat configured for resting on a support surface;

one or more support members configured for being operatively connected to the mat; and one or more entertainer components having one or more entertainment features for entertaining a child;

wherein, in the first configuration, the one or more support members extend upwardly and over the mat and at least a first entertainer component of the one or more entertainer components is coupled to one or more of the support members such that the first entertainer component is suspended above the mat; and wherein, in the second configuration, the first entertainer component is decoupled from the support members and the one or more entertainer components are configured in a table configuration to function as a children's entertainment table.

2. The children's play gym of claim 1, wherein the one or more entertainer components comprise the first entertainer component and a second entertainer component; and wherein, in the second configuration, the second entertainer component is coupled to the first entertainer component in the table configuration.

3. The children's play gym of claim 2, further comprising one or more base members operatively connected to the mat and configured for resting on the support surface;

wherein, in the first configuration, distal ends of the one or more support members are coupled to the one or more base members and the second entertainer component is coupled to at least one of the one or more base members; and wherein, in the second configuration, the second entertainer component is decoupled from the base members and coupled to the first entertainer component in the table configuration.

4. The children's play gym of claim 3, wherein the one or more base members comprise a first base member operatively connected to a first portion of the mat and a second base member operatively connected to a second portion of the mat opposite the first portion; and wherein, in the first configuration, the second entertainer component is coupled to the first base member and a kick pad is coupled to the second base member.

5. The children's play gym of claim 2, wherein the first entertainer component and second entertainer component each include one or more legs movable between a retracted position and an extended position;

wherein, in the first configuration, the legs of the first entertainer component and the second entertainer are in the retracted position; and wherein, in the second configuration, the legs of the first entertainer component and the second entertainer component are in the extended position and support the first entertainer component and second entertainer component in the table configuration.

6. The children's play gym of claim 5, wherein the legs of the first entertainer component are detachable from the first entertainer component; and wherein the legs of the second entertainer component are detachable from the second entertainer component.

7. The children's play gym of claim 5, wherein the legs of the first entertainer component are pivotably connected to the first entertainer component; and wherein the legs of the second entertainer component are pivotably connected to the second entertainer component.

8. The children's play gym of claim 1, wherein the first entertainer component includes one or more legs movable between a retracted position and an extended position;

wherein, in the first configuration, the legs of the first entertainer component are in the retracted position; and wherein, in the second configuration, the legs of the first entertainer component are in the extended position and support the first entertainer component in the table configuration.

9. The children's play gym of claim 1, further comprising one or more leg members;

wherein, in the first configuration, the one or more leg members are operatively connected to a portion of the play gym; and wherein, in the second configuration, the one or more leg members are secured to the first entertainer component in an extended position and support the first entertainer component in the table configuration.

10. The children's play gym of claim 1, wherein the first entertainer component defines one or more apertures extending through the first entertainer component;

wherein, in the first configuration, one or more of the support members extend through the one or more apertures, thereby coupling the first entertainer component to one or more of the support members and suspending the first entertainer component above the mat; and wherein, in the second configuration, the support members do not extend through the one or more apertures, thereby decoupling the first entertainer component from the support members.

11. The children's play gym of claim 1, wherein the first entertainer component includes one or more fasteners;

wherein, in the first configuration, the one or more fasteners are operatively connected to one or more of the support members, thereby coupling the first entertainer component to one or more of the support members and suspending the first entertainer component above the mat; and wherein, in the second configuration, the one or more fasteners are not connected to the support members, thereby decoupling the first entertainer component from the support members.

12. The children's play gym of claim 1, wherein the first entertainer component includes at least one sensing device, and wherein the one or more entertainment features are configured to react to input from a child sensed by the sensing device.

13. The children's play gym of claim 12, wherein the at least one sensing device comprises a motion sensor, and wherein the one or more entertainment features are configured to react to motion sensed by the motion sensor.

14. The children's play gym of claim 13, further comprising a kick pad operatively connected to one or more of the support members, the kick pad being positioned such that a child positioned on the mat may kick the kick pad in order to generate motion sensed by the first entertainer component's motion sensor.

15. The children's play gym of claim 12, wherein the at least one sensing device comprises a noise sensor, and wherein the one or more entertainment features are configured to react to noise sensed by the noise sensor.

16. The children's play gym of claim 12, wherein the one or more entertainment features comprise one or more lights or noise making devices.

17. A children's entertainment device for a play gym, the children's entertainment device comprising:

one or more entertainer components having one or more entertainment features for entertaining a child, the one or more entertainer components being convertible between an attachment configuration and a table configuration;

wherein, in the attachment configuration, at least a first entertainer component of the one or more entertainer components is configured for being removably coupled to one or more support members of a children's play gym; and wherein, in the table configuration, the one or more entertainer components are configured to function as a children's entertainment table.

18. The children's entertainment device claim 17, wherein the one or more entertainer components comprise the first entertainer component and a second entertainer component; and wherein, in the table configuration, the second entertainer component is coupled to the first entertainer component.

19. The children's entertainment device of claim 18, wherein the first entertainer component and second entertainer component each include one or more legs movable between a retracted position and an extended position;

wherein, in the attachment configuration, the legs of the first entertainer component and the second entertainer are in the retracted position; and wherein, in the table configuration, the legs of the first entertainer component and the second entertainer component are in the extended position and support the first entertainer component and second entertainer component in the table configuration.

20. The children's entertainment device of claim 17, wherein the first entertainer component includes one or more legs movable between a retracted position and an extended position;

wherein, in attachment configuration, the legs of the first entertainer component are in the retracted position; and wherein, in the table configuration, the legs of the first entertainer component are in the extended position and support the first entertainer component in the table configuration.

21. The children's entertainment device of claim 17, wherein the first entertainer component defines one or more apertures extending through the first entertainer component, the one or more apertures being configured for receiving one or more support members of a play gym in order to couple the children's entertainment device to the play gym.

22. The children's play gym of claim 17, wherein the first entertainer component includes at least one sensing device, and wherein the one or more entertainment features are configured to react to input from a child sensed by the sensing device.

* * * * *